United States Patent [19]

Kass

[11] 4,155,241

[45] May 22, 1979

[54] RASP BAR STRAIGHTENER FOR COMBINES

[76] Inventor: Kenneth J. Kass, Rte. 2, Box 156, Tracy, Minn. 56175

[21] Appl. No.: 862,638

[22] Filed: Dec. 20, 1977

[51] Int. Cl.[2] ..... B21D 3/10

[52] U.S. Cl. ..... 72/390; 72/454

[58] Field of Search ..... 72/390, 454, 457, 293, 72/305, 316

[56] References Cited

U.S. PATENT DOCUMENTS

| | | | |
|---|---|---|---|
| 1,484,558 | 2/1924 | Peto | 72/390 |
| 1,497,107 | 6/1924 | Lasell | 72/390 |
| 1,847,943 | 3/1932 | Griffin | 72/390 |
| 2,434,254 | 1/1948 | Benner | 72/390 |
| 2,531,728 | 11/1950 | Gersh | 72/390 |

*Primary Examiner*—C. W. Lanham

*Assistant Examiner*—Gene P. Crosby

*Attorney, Agent, or Firm*—Williamson, Bains, Moore & Hansen

[57] ABSTRACT

The invention relates to a device for straightening combine rasp bars mounted on a rasp bar wheel. The device includes a bar having at one end a surface designed to engage the rasp bar axle. The other end of the bar is telescopingly received in a sleeve having located therein a bolt for adjustably positioning the bar within the sleeve. Attached to the outside of the sleeve is a wedge which serves to engage the inner side of the rasp bar so that the rasp bar may be bent outward to its original position by use of the positioner between the bar and the sleeve. Attached outwardly of the engaging wedge on the sleeve is an underslung receiving pocket which receives a crossbar having at either end bolts which may be used to force the rasp bar inward.

9 Claims, 4 Drawing Figures

FIG. 1
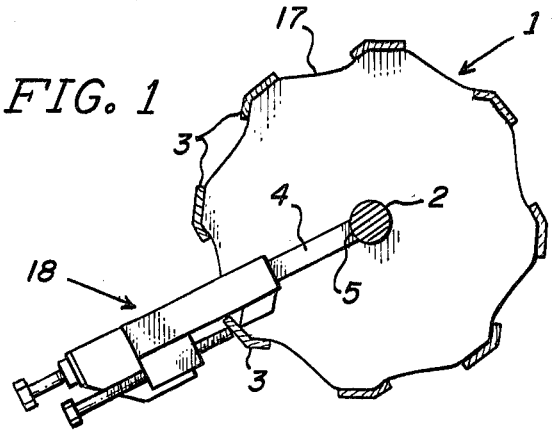
FIG. 2
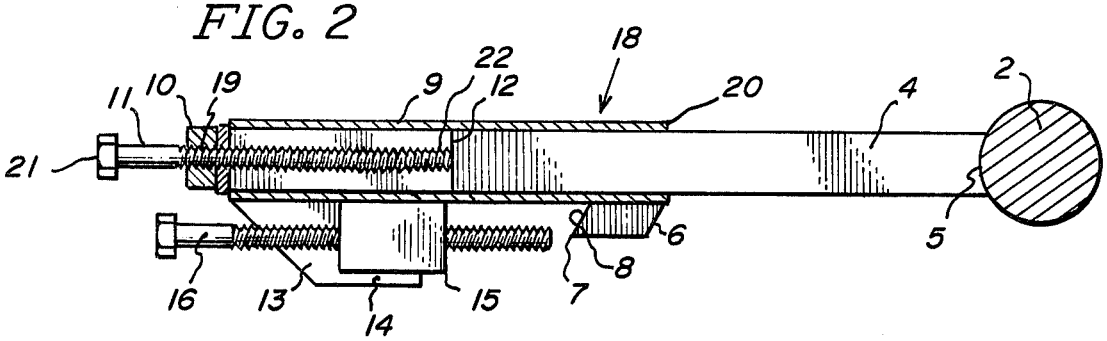
FIG. 3
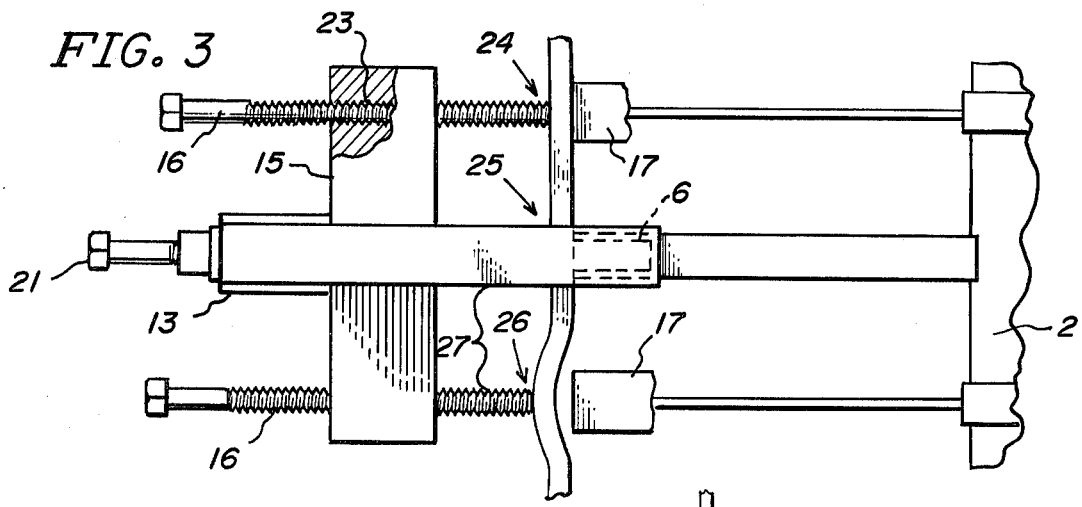
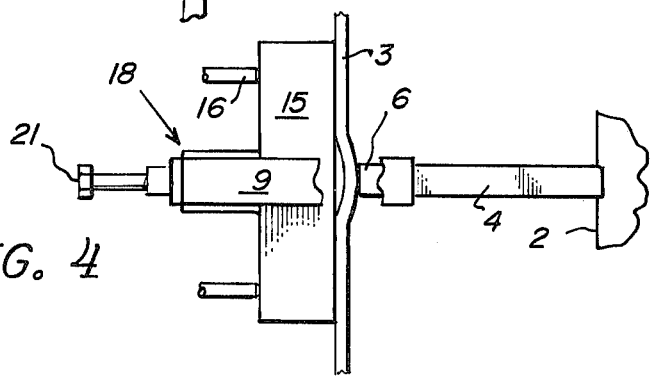
FIG. 4

RASP BAR STRAIGHTENER FOR COMBINES

BRIEF SUMMARY OF THE INVENTION

This invention relates to a device for straightening rasp bars which are mounted on rasp bar wheels and various combines. Bent rasp bars have often been a problem in that the intake of stones or other undesirable materials in the combine will often bend the rasp bars. Heretofore the only realistic way in which such bars could be straightened was to unbolt the rasp bars from the combine and straighten them by use of a hammer or other such crude devices. Such a method of straightening the bars often proved to be time consuming and inefficient.

It is an object of the present invention then to provide a device which may be used to straighten the rasp bars while they are mounted on the rasp bar wheel in the combine. It is a further object of the invention that this device may be easily and quickly utilized for effecting such repairs. It is a further object of this invention that the device be relatively small and portable such that it may be carried in the combine for use in the field. It is also an object of the invention that the device be inexpensively manufactured so as to be economically feasible for the farmer to purchase.

In the preferred form of my invention an elongated bar is provided at one end with the surface which is shaped to engage a combine rasp bar wheel axle. The other end of the bar is telescopingly encompassed by a sleeve slidable thereon. The sleeve has at one end a threaded bore for accommodating a bolt which bears against the end of the bar in order to position the bar relative to the sleeve. The sleeve also has a wedge-shaped engaging piece at one end which serves to engage the backside of the rasp bar so that the rasp bar may be bent outwards from the axle. At the end of the sleeve containing the threaded bore, an underslung pocket is provided which slidably receives a crossbar which may be slid perpendicular to the axis of the sleeve and elongated bar. This bar has at either end bolts threaded into it, the bolts passing completely through the crossbar. These bolts may be utilized to bend the rasp bar in a direction towards the axle. These and other objects and advantages of my invention will become readily apparent as the following description is read in conjunction with the accompanying drawings wherein like reference numerals are used to describe the several views.

DESCRIPTION OF THE DRAWING FIGURES

FIG. 1 is a side view showing the invention in engagement with the combine axle and a rasp bar.

FIG. 2 is a cross section of the rasp bar straightener taken along its longitudinal axis.

FIG. 3 is a plan view of the device being used to force a bent rasp bar inward.

FIG. 4 shows the device being utilized to bend a rasp bar outwards.

DESCRIPTION OF THE PREFERRED EMBODIMENT

A rasp bar wheel generally 1 is comprised of an axle 2 and an outer wheel periphery 17. Rasp bars 3 are mounted on the outer periphery 17 of the rasp bar wheel and lie parallel to the axle 2 of the wheel.

Rasp bar straightener 18 is comprised generally of an elongated bar 4 having at one end an axle engaging portion 5 which is so shaped as to contact the combine rasp bar wheel axle. The other end of the elongated bar 4 is a generally rectangular flat face 12. Elongated bar 4 is slidingly and telescopingly received with an elongated rectangular sleeve 9. Bar 4 is received at end 20 of sleeve 9. The other end of elongated sleeve 9 has affixed thereto by welding or other known means an end portin 10 which has located therein threaded aperture 19. Threaded into aperture 19 is an elongated bolt 11 which may be rotated via head 21 to adjustably locate bolt end surface 22 against end 12 of elongated bar 4 in order to adjustably position elongated bar 4. Attached near end 20 of elongated sleeve 9 is a retaining piece 6 which may be welded or attached by other well known means to sleeve 9. Engaging piece 6 has located at its side facing end 10 of elongated sleeve 9 a rasp bar engaging surface 8 which presents a wedge-shaped pocket for receiving a rasp bar therewithin. Engaging surface 8 terminates at engaging edge 7 which serves to further engage a rasp bar being straightened via a line contact. Engaging piece 6 is rectangular in cross section along the axis of elongation of both bar 4 and sleeve 9. Attached near end 10 of elongated sleeve 9 is restraining piece 13 which is fixedly attached to sleeve 9 having a carrying portion 14 attached thereto. Pieces 13 and 14 form a pocket for snugly receiving crossbar 15 which is slidable in said pocket perpendicular to the axis of elongation of bar 4 and sleeve 9. Crossbar 15 comprises a generally solid block of material such as steel having at either end threaded apertures 23 which threadedly engage elongated bolt 16 which may be used to straighten rasp bars.

OPERATION OF THE INVENTION

The operation of the device to straighten the rasp bars is illustrated particularly in FIGS. 1, 3 and 4. As shown in FIG. 1 rasp bar wheel 1 is not actually a solid cylindrical device but rather the periphery 17 of wheel 1 is a skeletal framework which mounts rasp bars 3 thereon. As a result the straightening device 18 is partially inserted through the periphery 17 of wheel 1 and the shaped end 5 of elongated bar 4 is placed so as to abuttingly engage rasp bar wheel axle 2. Bolt 11 is then adjusted by turning head 21 thereof so that engaging piece 6 which is attached to sleeve 9 engages the inward side of rasp bar 3 as shown particularly in FIGS. 1 and 4. At this point, engaging surface 8 and/or engaging edge 7 will grip the backside of rasp bar 3 depending on the angular orientation of the particular rasp bar. As illustrated particularly in FIG. 4 engaging piece 6 is placed directly at an inward bend at which point head 21 of bolt 11 is then turned thereby moving sleeve 9 outwardly with relation to elongated bar 4 which as a result pushes bent rasp bar 3 into a straightened configuration.

Although rasp bars 3 are generally bent inwardly as shown in FIG. 4, due to ingested stones and the like, occasionally the bar will be bent outwardly as shown in FIG. 3. Such an outward bend may also result from the rasp bar being bent excessively in the outward direction in the straightening operation described above. As this operation is not always exact, several successive operations of inward and outward bending may be necessary in order to obtain a straightened bar. Particularly as illustrated in FIG. 3, the straightening device is located on the rasp bar such that the outwardly bent portion 26 is located at one of elongated bolts 16. Engaging piece 6 and the other elongated bolt 16 are so located and adjusted at points 25 and 24 respectively on rasp bar 3 that the straightening device has its axis of elongation perpendicular to the normal straightened longitudinal extent of the rasp bar (excluding the bend). At this point elongated bolt 16 at point 26 is cranked inwardly thereby bending rasp bar 3 inwardly at that point. The length or leverage 27 over which elongated bolt 16 acts may be adjusted by sliding crossbar 15 within receiving portions 13 and 14 of the straightening device.

It is contemplated that various changes and modifications may be made to my rasp bar straightener without departing from the spirit and scope of my invention as defined by the following claims.

What is claimed is:

1. A device for straightening combine rasp bars which are mounted to a rasp bar wheel having a center shaft, said device comprising:

an elongated bar having a first end and a second end, said first end having a surface to contact a rasp bar wheel center shaft and prevent dislodgment of said device relative thereto;

an elongated piece having first and second ends, said first end being slideably mounted to said elongated bar, the axes of elongation of said bar and said piece being substantially parallel;

means for positioning elongated said bar relative to said piece;

engaging means fixedly secured to said piece, said engaging means being disposed so that when said bar first end contacts said center shaft, said engaging means engages the inner side of one of said rasp bars so as to force said rasp bar radially outwardly from said center shaft.

2. The device of claim 1 wherein said engaging means comprises a block which protrudes angularly from said elongated piece and forms a wedge-shaped pocket, said pocket facing in the direction of said second end of said piece, wherein the outer edge of said block terminates in a pointed edge forming the outer boundary of said pocket, said edge also facing in the direction of said second end of said piece.

3. The device of claim 1 further comprising:

a crossbar having two ends and a longitudinal axis; said crossbar having bending means at each of said ends movable to push a bent rasp bar away from said crossbar axis; said bending means being substantially parallel to said elongated bar; and means on said elongated piece for receiving said crossbar and restraining said crossbar against movement towards said second end of said piece; said restraining means being closer to said second end of said piece than said engaging means;

whereby when said rasp bar is bent outward, said bending means are located on the outward side of said rasp and said engaging means is located on the inner side of said rasp bar so that at least one of said bending means may be moved to straighten said rasp bar and move said rasp bar toward said center shaft.

4. The device of claim 3 wherein said restraining means allows said crossbar to slide in a direction perpendicular to the direction of elongation of said elongated bar.

5. The device of claim 3 wherein said restraining means further comprises means for preventing rotation of said crossbar relative to said elongated piece.

6. The device of claim 5 wherein said rotation prevention means comprises means for providing planar support in a plane parallel to said axis of elongation of said elongated piece and means for providing planar support in a plane perpendicular to said axis of elongation of said planar piece.

7. The device of claim 1 wherein said elongated piece is an elongated sleeve and said elongated bar is telescopingly received in said sleeve.

8. The device of claim 7 wherein said positioning means comprises a bolt threaded into said second end of said sleeve, the end of said bolt bearing against said second end of said elongated bar.

9. A device for straightening combine rasp bars which are mounted to a rasp bar wheel having a center shaft, said device comprising an elongated piece having first and second ends;

engaging means fixedly secured to said piece; a crossbar having two ends and a longitudinal axis; said crossbar having bending means at each of said ends movable to push a bent rasp bar away from said crossbar axis; said bending means being substantially parallel to said elongated piece; and means on said piece for receiving said crossbar and restraining said crossbar against movement towards said first end of said piece; said restraining means being closer to said first end of said piece than said engaging means, whereby when said rasp bar is bent outward, said bending means are located on the outward side of said bar and said engaging means is located on the inner side of said bar so that at least one of said bending means may be mounted to straighten said rasp bar and move said rasp bar toward said center shaft;

an elongated bar having a first end and a second end, said first end having a surface to contact a rasp bar wheel center shaft and prevent dislodgment of said device relative thereto said elongated piece second and being slideably mounted to said elongated bar, the axes of elongation of said bar and said piece being substantially parallel;

means for positioning said bar relative to said piece; and said engaging means being disposed so that when said bar first end contacts said center shaft, said engaging means engages the inner side of said rasp bar so as to force said rasp bar radially outwardly from said center shaft.

* * * * *

UNITED STATES PATENT AND TRADEMARK OFFICE

CERTIFICATE OF CORRECTION

PATENT NO. : 4,155,241

DATED : May 22, 1979

INVENTOR(S) : Kenneth J. Kass

It is certified that error appears in the above-identified patent and that said Letters Patent are hereby corrected as shown below:

Column 2, Line 7: Delete "portin" and substitute --portion--.

Column 3, Line 25: Delete "elongated said bar" and substitute --said elongated bar--.

Column 3, Line 56: Insert --bar-- after "rasp".

Column 4, Line 48: Insert a semi-colon after "thereto".

Column 4, Line 49: Delete "and" and insert --end--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*